US008720126B2

(12) United States Patent
Strickland et al.

(10) Patent No.: US 8,720,126 B2
(45) Date of Patent: May 13, 2014

(54) TRANSPORTABLE, EXPANDABLE CONTAINERS AND EMERGENCY STRUCTURES FOR HABITAT AND FIELD USE

(75) Inventors: Joseph George Strickland, Carmel Valley, CA (US); Jack Arthur Paquin, Monterey, CA (US)

(73) Assignee: Jack Dempsey Stone & Rapid Fabrications IP LLC, Sims, NC (US)

( * ) Notice: Subject to any disclaimer, the term of this patent is extended or adjusted under 35 U.S.C. 154(b) by 0 days.

(21) Appl. No.: 13/506,659

(22) Filed: May 7, 2012

(65) Prior Publication Data

US 2013/0291449 A1 Nov. 7, 2013

(51) Int. Cl.
*E04B 1/344* (2006.01)

(52) U.S. Cl.
CPC ..... *E04B 1/3442* (2013.01)
USPC ..... 52/79.5; 52/71; 52/143

(58) Field of Classification Search
CPC ..... E04B 1/3442
USPC ..... 52/79.5, 143, 71
See application file for complete search history.

(56) References Cited

U.S. PATENT DOCUMENTS

| | | | | |
|---|---|---|---|---|
| 2,780,844 | A | 2/1957 | Bolt | |
| 4,007,833 | A * | 2/1977 | Bigelow, Jr. | 206/321 |
| 4,891,919 | A * | 1/1990 | Palibroda | 52/79.5 |
| 4,912,891 | A | 4/1990 | Bertrand | |
| 5,237,784 | A * | 8/1993 | Ros | 52/79.5 |
| 5,444,944 | A * | 8/1995 | Roelofsz | 52/64 |
| 5,596,844 | A * | 1/1997 | Kalinowski | 52/79.5 |
| 5,761,854 | A * | 6/1998 | Johnson et al. | 52/69 |
| 5,890,341 | A | 4/1999 | Bridges et al. | |
| 6,223,479 | B1 * | 5/2001 | Stockli | 52/68 |
| 6,772,563 | B2 * | 8/2004 | Kuhn | 52/67 |
| 6,789,361 | B1 | 9/2004 | Spartz et al. | |
| 6,983,567 | B2 * | 1/2006 | Ciotti | 52/79.5 |
| 7,290,372 | B2 * | 11/2007 | Aust et al. | 52/67 |
| 7,418,802 | B2 | 9/2008 | Sarine et al. | |
| 7,784,845 | B2 * | 8/2010 | Kim et al. | 296/26.01 |
| 7,823,337 | B2 * | 11/2010 | Pope | 52/67 |
| 7,832,151 | B2 | 11/2010 | Harrisson et al. | |
| 7,841,136 | B2 * | 11/2010 | Czyznikiewicz | 52/71 |
| 7,874,107 | B1 | 1/2011 | Medley et al. | |
| 7,882,659 | B2 * | 2/2011 | Gyory et al. | 52/79.5 |

(Continued)

FOREIGN PATENT DOCUMENTS

EP 0 127 070 * 12/1984

*Primary Examiner* — Robert Canfield
(74) *Attorney, Agent, or Firm* — Myers Bigel Sibley & Sajovec, PA

(57) ABSTRACT

The invention is an expandable and contractible, transforming habitable structure, ISO-certified container designed as a single unit with all primary components contained within, to be easily transported by water, air or land (truck and rail) in stacked configurations. The unit of fold-down floors, easy swing-out interior and exterior walls, and an inter-locking roof system, rapidly expands using: specially designed and engineered "box hinges" and "pivot pins." When expanded, the unit is structurally secured via especially designed and engineered "spring bolts" requiring little construction knowledge or tools, into HUD-approved, habitable, family friendly structure for emergency and temporary individual, or single-family use, and can be combined in multiples for various field functional applications. The design and engineering of floor, wall and roof (stored for transport within the container) components allow for their simple maintenance by the removal and replacement of some bolts or specially designed and engineered "spring-loaded hinges."

19 Claims, 23 Drawing Sheets

(56) References Cited

U.S. PATENT DOCUMENTS

| | | | | |
|---|---|---|---|---|
| 8,112,943 | B2 | 2/2012 | Medley et al. | |
| 8,141,304 | B2 | 3/2012 | Shen et al. | |
| 8,166,715 | B2 * | 5/2012 | De Azambuja | 52/79.5 |
| 8,347,560 | B2 * | 1/2013 | Gyory et al. | 52/79.5 |
| 2002/0116878 | A1 * | 8/2002 | Ciotti | 52/64 |
| 2007/0107321 | A1 * | 5/2007 | Sarine et al. | 52/71 |
| 2009/0217600 | A1 | 9/2009 | De Azambuja | |
| 2010/0064601 | A1 * | 3/2010 | Napier | 52/79.5 |
| 2010/0147842 | A1 | 6/2010 | Reynard et al. | |
| 2010/0218436 | A1 * | 9/2010 | Colquhoun | 52/79.5 |
| 2012/0060430 | A1 * | 3/2012 | Laprise et al. | 52/79.5 |
| 2012/0151851 | A1 * | 6/2012 | Cantin et al. | 52/79.5 |
| 2012/0255240 | A1 * | 10/2012 | Shen | 52/79.5 |
| 2013/0014450 | A1 * | 1/2013 | Esposito | 52/11 |
| 2013/0074424 | A1 * | 3/2013 | Trascher et al. | 52/79.5 |

* cited by examiner

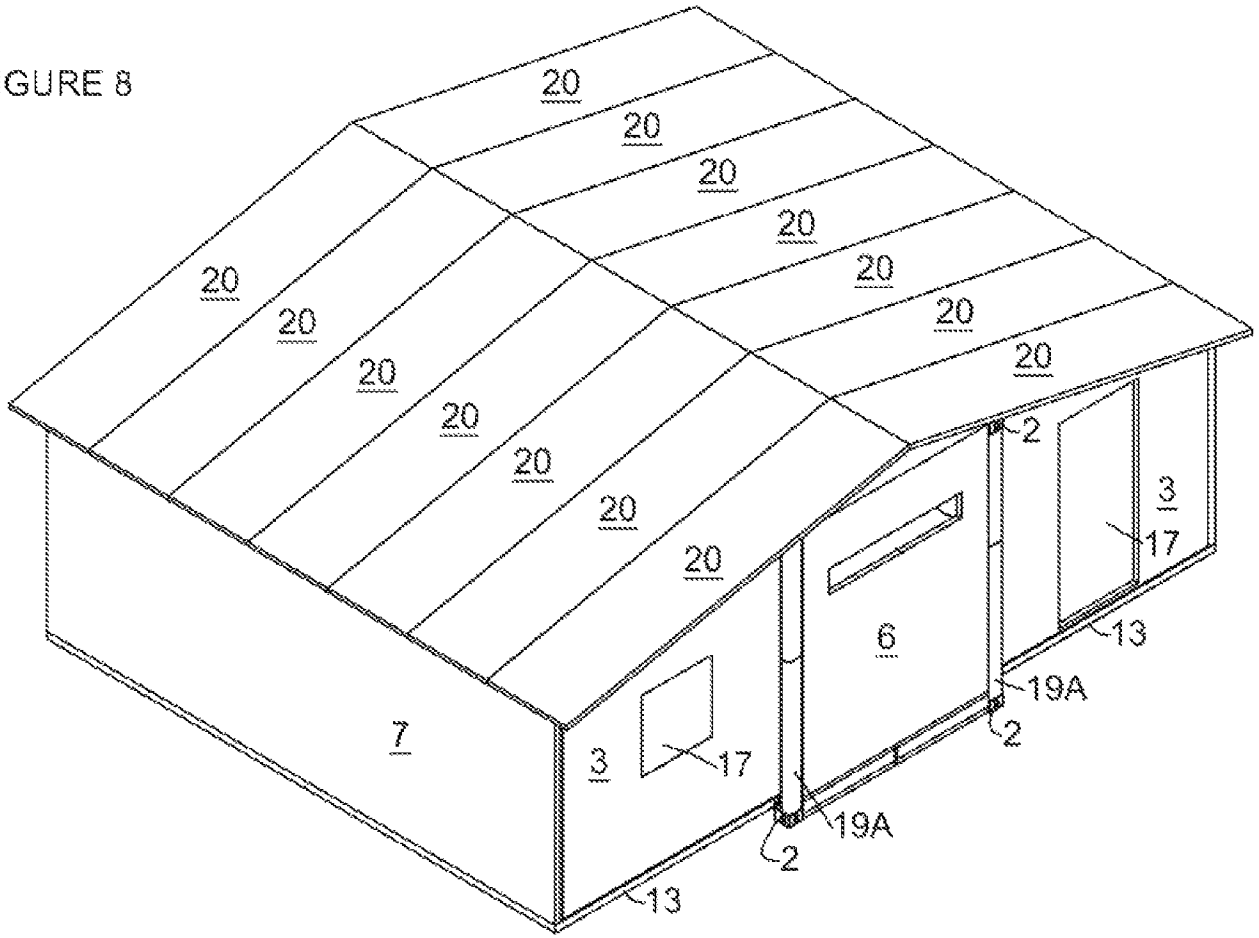
20
20
20

TRANSPORTABLE, EXPANDABLE CONTAINERS AND EMERGENCY STRUCTURES FOR HABITAT AND FIELD USE

CROSS-REFERENCE TO RELATED APPLICATION

This non-provisional utility patent application claims the benefit of a provisional patent application under 35 USC §119(e) with the provisional application No. U.S. 61/518,443 and acceptance date of May 5, 2011. Accompanying this application is a singular table (PTO/SB 08a) referencing prior art referred to in this application as it relates to this invention

FEDERALLY SPONSORED RESEARCH OR DEVELOPMENT

This invention was not federally sponsored or co-sponsored, and there are no federal rights to the invention under federally sponsored research and development.

MATERIAL SUBMITTED ON COMPACT DISCS

There are no materials submitted on compact disc(s).

BACKGROUND OF THE INVENTION

This invention relates to building structures which meet the Department of Housing and Urban Development (HUD) requirements for housing, more particularly, to a habitable shelter for immediate occupancy in the case of an emergency or permanent housing that, in their transportable state, satisfy international standards and regulations regarding transporting and storage ability, including International Organization for Standardization (ISO), Container Safety Convention (CSC), and Coast Guard Certification (CGC) standards. They also meet the standards which Federal Emergency Management Agency (FEMA) and other agencies and municipalities may require for their marketability and installation in rapid short-to-medium term deployment. Other "container houses," which are not current certified ISO-approved containers, or HUD-approved habitable structures, are limited to modes of transportation and shipping which greatly inhibit or make impractical or impossible their deployment to various areas and geographical terrains where they are needed in times of emergency, additionally have considerable delays in meeting state and local municipal codes and site preparations. This invention serves to at least minimize if not altogether alleviate these obstacles to: rapid deployment by diverse means; ease of installation by nonprofessional, unskilled personnel in a variety of terrains and ecological climates: economic use, reuse, cleanup, storage and reuse.

DISCUSSION OF THE PRIOR ART

Refer to PTO/SB 08a (07-09), made a part of this application by inclusion herewith, for relevant prior and existing art.

There is no question as to the absolute, existing, ongoing need for economical, easily deployable, quickly installable, plug-n-play emergency housing units. Research of prior art has revealed uniquely creative, innovative and original work. This art encompasses shippable, containerized units which are retrofitted to create structures or make references like "container like" or "shaped like" a shipping container. In one case, the integrity of the certified container is compromised and in the other, certification does not exist. There is a standard for transportation, the International Organization for Standards (ISO) and all who transport want and at times need this certification, so it is a standard all want to be associated with, but most only give reference in words not certification. The structures of some of these past inventions have not been built to standards of U.S. Department of Housing and Urban Development (HUD), a requirement the Federal Emergency Management Agency (FEMA) and other emergency agencies now require for all emergency housing. However, although patents have been issued, as noted in the cited references, their issuances have come and gone as none of the units apparently have been practical or economical enough to produce, or convenient enough to deploy and install without a tremendous amount of cost, skilled labor, equipment and tools, permitting, or pre-approval by state and local authorities. Presently answers to the extreme emergency housing shortage in way of existing art forms and commercial production units meeting the certification requirements of the entities needing and purchasing them, remain unanswered and unfulfilled.

It is questionable whether the prior art will withstand testing to meet the criteria of present-day governments and agencies for "emergency" or "ecological" temporary emergency housing, currently the greatest demand of both domestic and international markets in light of the trend of increasing disasters globally.

Some of these tests include: (1) durability, especially in withstanding high winds, temperature extremes and both human and natural element abuse, including water tightness meeting HUD standards; (2) flexibility, deploy-ability and install-ability, meeting ISO approval and certification, stackable, easily loaded and unloaded in a variety of conditions and easily installed with a minimum of costs, by whatever means are available, whether from a flatbed truck or dropped in by a helicopter, and set up on un-even terrain with a minimum of manpower in a minimal amount of time, and with footing sufficient to meet local soil-density standards; (3) fully and readily equipped with the basic infrastructure to provide heating and, air-conditioning, alternative energy sources, plumbing to provide both emergency fresh-sanitation water and gray-water holding, as well as municipal water, and waste disposal capabilities meeting HUD standards; (4) light weight enough to meet local soil density standards set forth by state and local governments; (5) recyclability, restorability and reusability, integral parts economically replaced, ecologically constructed to facilitate upkeep, cleaning and storing for subsequent uses; (6) value and affordability, designing the size, materials and features to facilitate the least costs of purchasing, transporting and installing each unit so as to be able to reach various end-user markets; (7) salvage ability in that the materials used in construction afford a significant salvage value; and, (8) equally as important, environmentally family friendly, creating both the interior and exterior design and features to provide a "home" environment, and true modifiable internal functionality to meet a diversity of applications and requirements. Furthermore, existing art (actively patented) neither provides the design nor the features for deployability into various environments by all existing means of transportation as emergency housing, nor the functionality to be marketable as such, hence the need for this invention.

It is both desirable and essential to overcome the problems as set forth above, if governments and agencies are to provide the ongoing critical shortage in emergency housing, both in the United States and internationally. The design of this invention provides a unique, differentiated and viable solution to this critical shortage.

SUMMARY OF THE INVENTION

Brief Summary of the Invention

During emergencies, safe, swift and dependable deployment is the top priority of all concerned. This begins with the logistics of getting the shelters to the emergency location. Unlike prior inventions which are "container configuration" U.S. Pat. No. 7,882,659, "container type" U.S. Pat. No. 8,141,304 B2 or "general form of a container" U.S. Pat. No. 5,237,784, this invention is a certified ISO container HUD certifiable home/structure and has many options to choose from to deploy it into action by: truck, train, plane, ships, helicopters and other transport aircraft, all being standard modes of transportation with requirements and standards set by ISO which this invention meets.

The principle purpose of the certified container structure is to rapidly provide a comforting and private house with HUD certification, to individual families who have very recently lost their homes due to any number of causes. No other transportable container homes are built to HUD standards, which FEMA requires for emergency homes. This invention eliminates problems that have been common in the mechanical transportation, deployment and assembly of temporary housing, in the load-bearing requirements of local codes, and in the uncomfortable an impractical nature of other expandable temporary housing units.

When in the retracted transportable position, one element of the present invention provides a sealed ISO-certified container with embodied features for deployment by both forklift and crane-(from land or air), a retractable jack system (combination mechanical, electrical and/or hydraulic/pneumatic) for unassisted unit lifting and deployment off trailers and leveling on uneven surfaces, and steel columns with international standardized provisions for mechanical hoisting, multiple unit stacking and storage.

Another object of the invention is the design and placement of certain related mechanical components preventing excessive manual or mechanical stress to components either in the course of deployment or extraction or from environment (wind, temperature) forces. An optional variant of the presented object framework system will meet or exceed the requirements for real deployment by air and surviving the impact stresses therefrom.

When all flooring and wall panel members have mechanically pivoted to their habitable position and the roofing members are locked in place, a safe, secure, sturdy, handicap-accessible, climate-controlled, habitable structure with full plumbing and electrical supply results, thus defining the definition of the invention. The floor members pivot 90 degrees to be parallel along the elongated dimensions of the main framework while the exterior/interior wall panels rotate 90 degrees while oriented in a vertical position from corresponding pivot points within the main framework. Further, when flooring members have been oriented in the expanded horizontal mode, the remaining longitudinal exterior wall members, in the current horizontal position, are pivoted from the outer longitudinal edge of the expanded floors 90 degrees to a vertical position, to form the space required to occupy the floor plan. All components require simple knowledge of the "swinging" action of a door, no "drawing out" as required by some shelters, as U.S. Pat. No. 8,141,304 B2 or cranes required as with US 2009/0217600 which requires the roof section to be "lifted" into position.

The top insulated metal roof panels of the main framework are attached in a method that provides security and provisions for attachment of corresponding roof panels for both longitudinal sides of the main frame. Along the upper interior edge of the wall panels, the remaining expandable exterior/interior vertical wall panels will have locking mechanisms to join the interlocking roof panels to the pivoting walls. Together, these interlocking floor, wall and roof systems will be engineered to comply with HUD standards for habitable structures, and when coupled, grouped or combined, meet multiple-use requirements for not only emergency but long-term housing and other field applications.

The completed building ultimately involves expanding components by means of unfolding and attaching roofing components which, when in the transportable certified ISO container position are stored within the building mainframe. Some of the panels, namely the roofing panels, may not be designed to hinge.

The transportable certified building container is made ready for habitat prior to deployment by providing within the structured walls, floors and roof of the main frame, and either 120-volt (domestic U.S.) or 220-volt standard (international) electrical service and full plumbing fixtures. Other amenities include hot water, sinks, toilet and bath/shower with fully functioning water-supply-side and disposable (gray water) release-side drainage piping systems linkable to municipal systems and/or meeting temporary dumping requirements. The building features an ADA-compliant kitchen, bathroom, doors, windows and hallways and conforms to International Building Code standards. Still other optional features include solar back-up power and self-contained water-holding bladders or tanks contained within the structure of the fold-out unit.

BRIEF DESCRIPTION OF SEVERAL VIEWS OF THE DRAWINGS

FIG. 8 is an Isometric view on the invention in the open habitable position;

FIG. 9A is a top view of two roof panels secured together. FIG. 9B is a sectional view taken along the line 9B-9B of FIG. 9A. FIG. 9C is an enlarged sectional view illustrating the interconnection between adjacent roof panels.

EMBODIMENTS OF THE INVENTION

Figure 2:
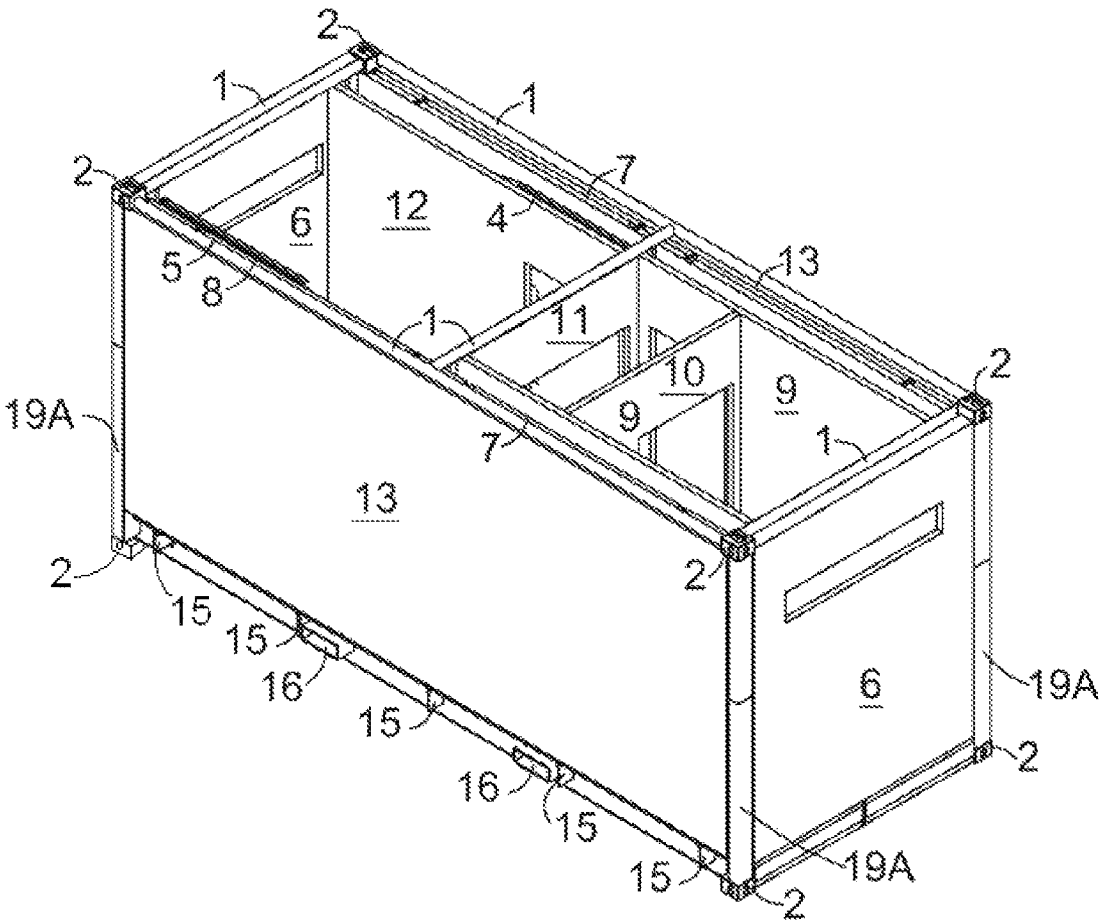
FIG. 2 is an isometric view of the invention in the closed ISO certified container transportable position in which the container roof is not shown in order to exhibit other details.
Figure 3:
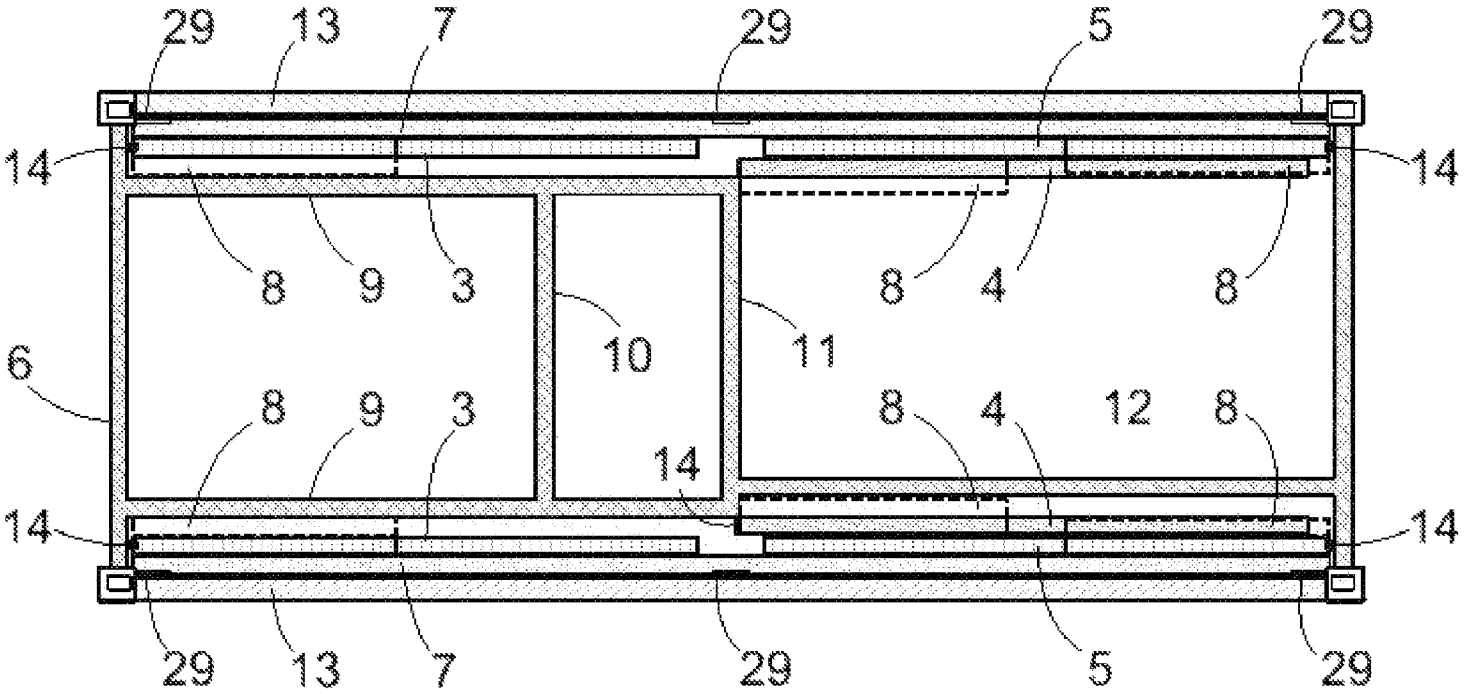
FIG. 3 is a top view of the invention in the closed certified container position in which the permanent container roof is not shown in order to exhibit other details.
Figure 4:
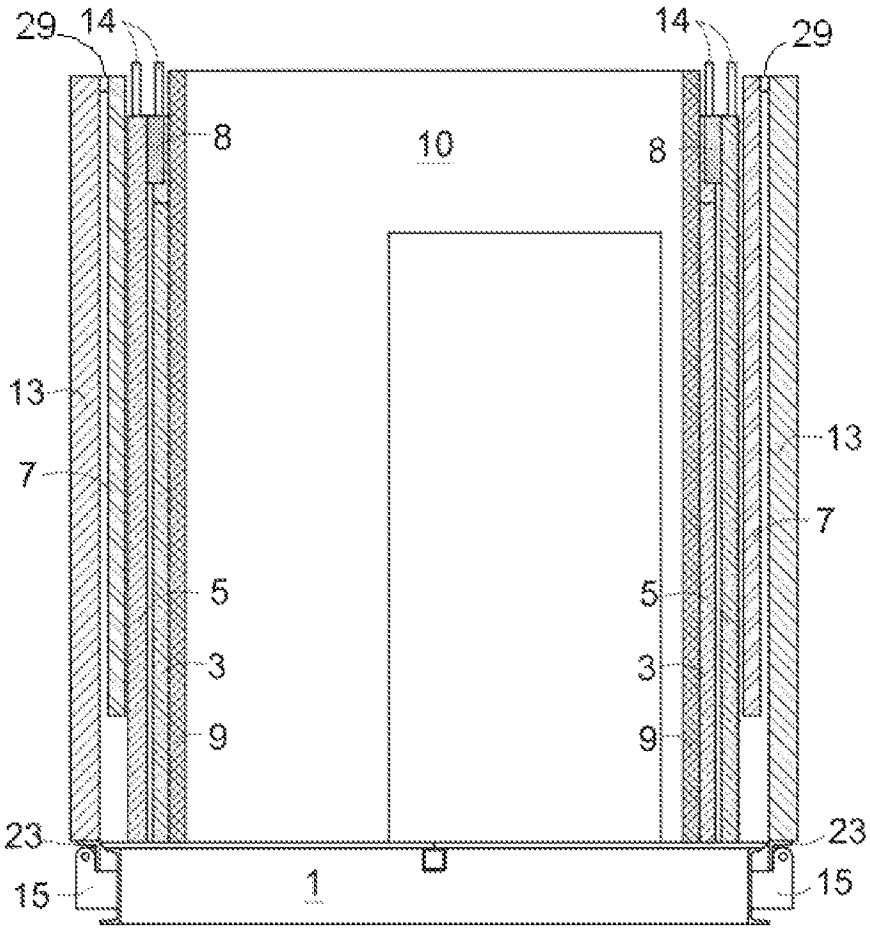
FIG. 4 is a cross-sectional view of the unit in the closed certified transportable position.
Figure 5A:
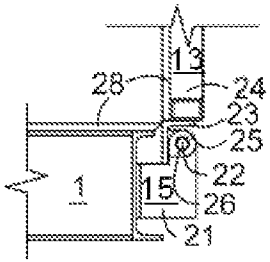
FIGS. 5A-C are detailed views of "pivot hinge,"—the specially designed and engineered floor hinge providing rotation from the closed to the open positions.
Figure 5B:
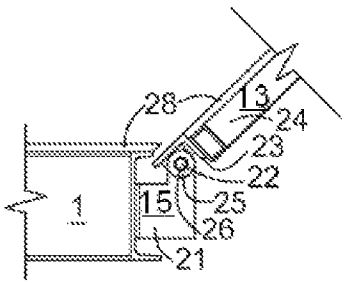
Figure 5C:
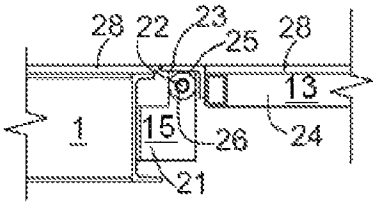
Figure 7:
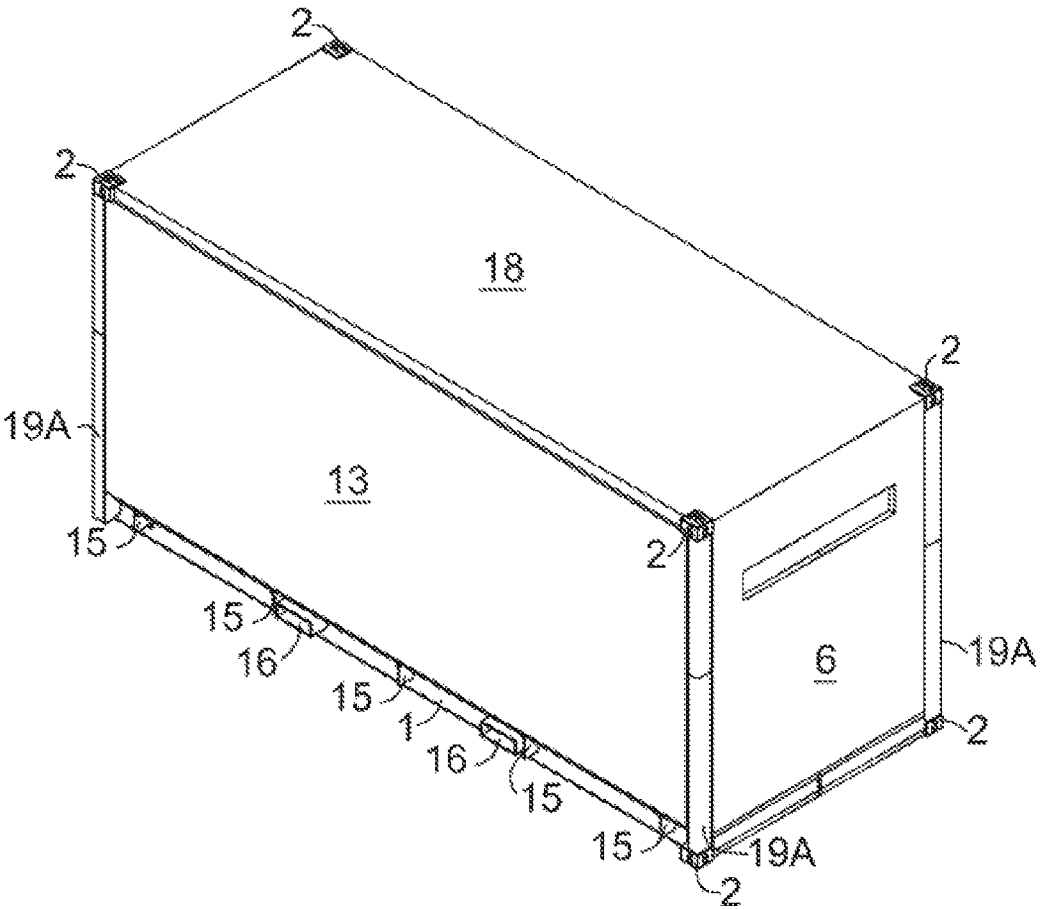
FIG. 7 is an isometric view on the invention in the closed transportable position.
Figure 9B:
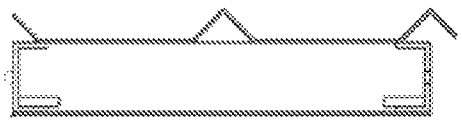
FIGS. 9A-9C illustrate roof panels and associated connections according to some embodiments.
Figure 9C:
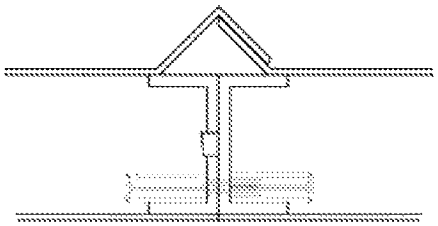
Figure 9A:
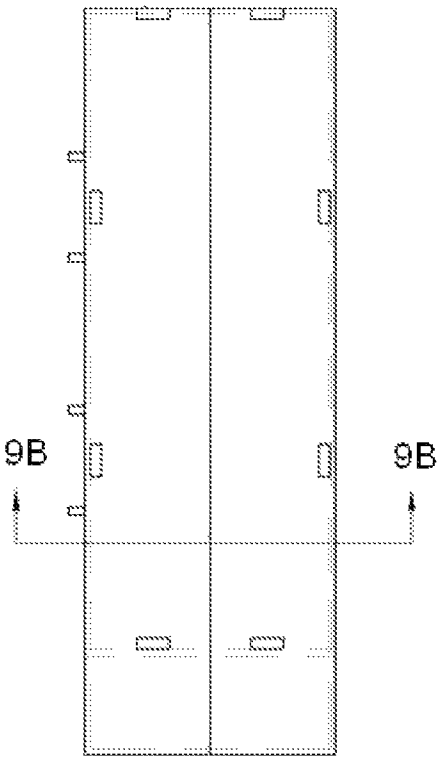

In reference to FIGS. 2, 3 and 7, the emergency transportable expandable certified container for habitat is illustrated in its closed transportable form, as a current certified ISO shipping container. In its closed transportable form, the unit has two end walls 6, a permanent roof 18, longitudinal walls made up of the fold up floor 13, and required ISO cast corner fittings 2 mounted on each of the four corners of the invention to provide for the attachment of lifting hooks and coupling pins for attachment to other units when stacked.

Figure 10:
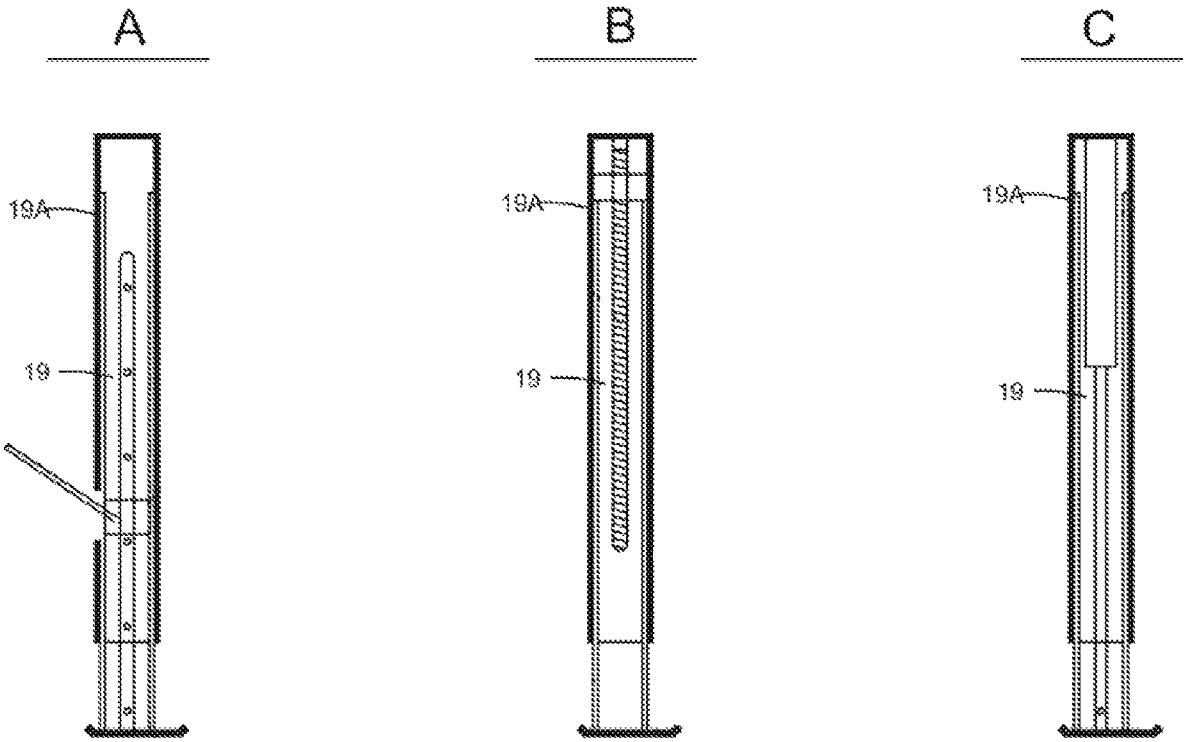
FIG. 10A-C are side views of the three types of jack systems—mechanical, electrical and pneumatic/hydraulic—and which will be installable within the interior structure of the mainframe corners of the certified container.
Figure 11:
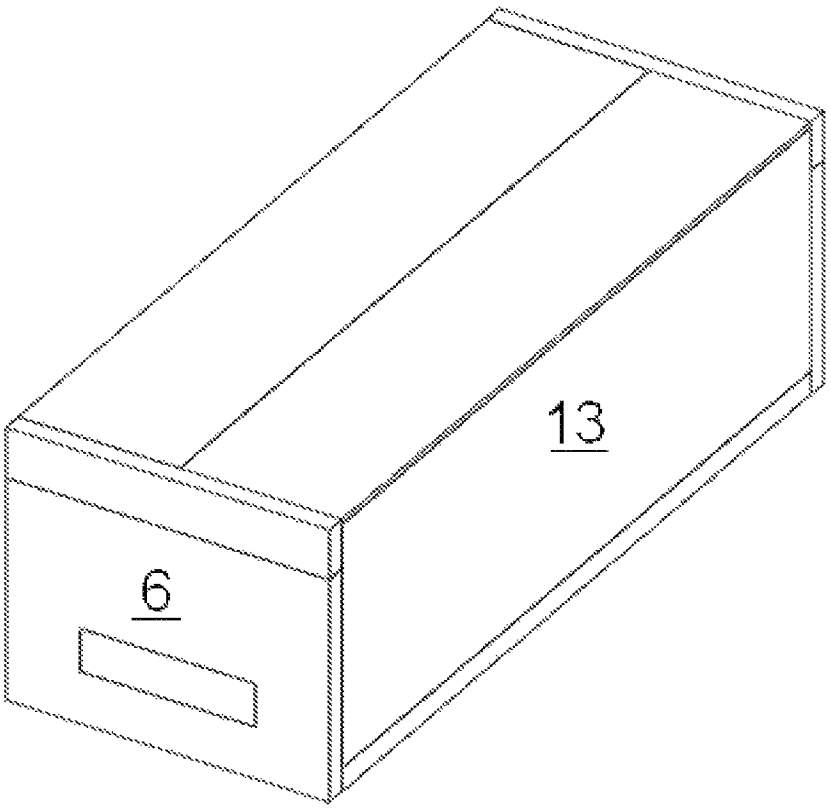
FIGS. 11-22 are various isometric views exhibiting the fold-out sequence of the invention in a variant roof-structure format; and, FIG. 23 comprises a top view with roof removed to reveal a typical floor plan of a deployed unit.
Figure 12:
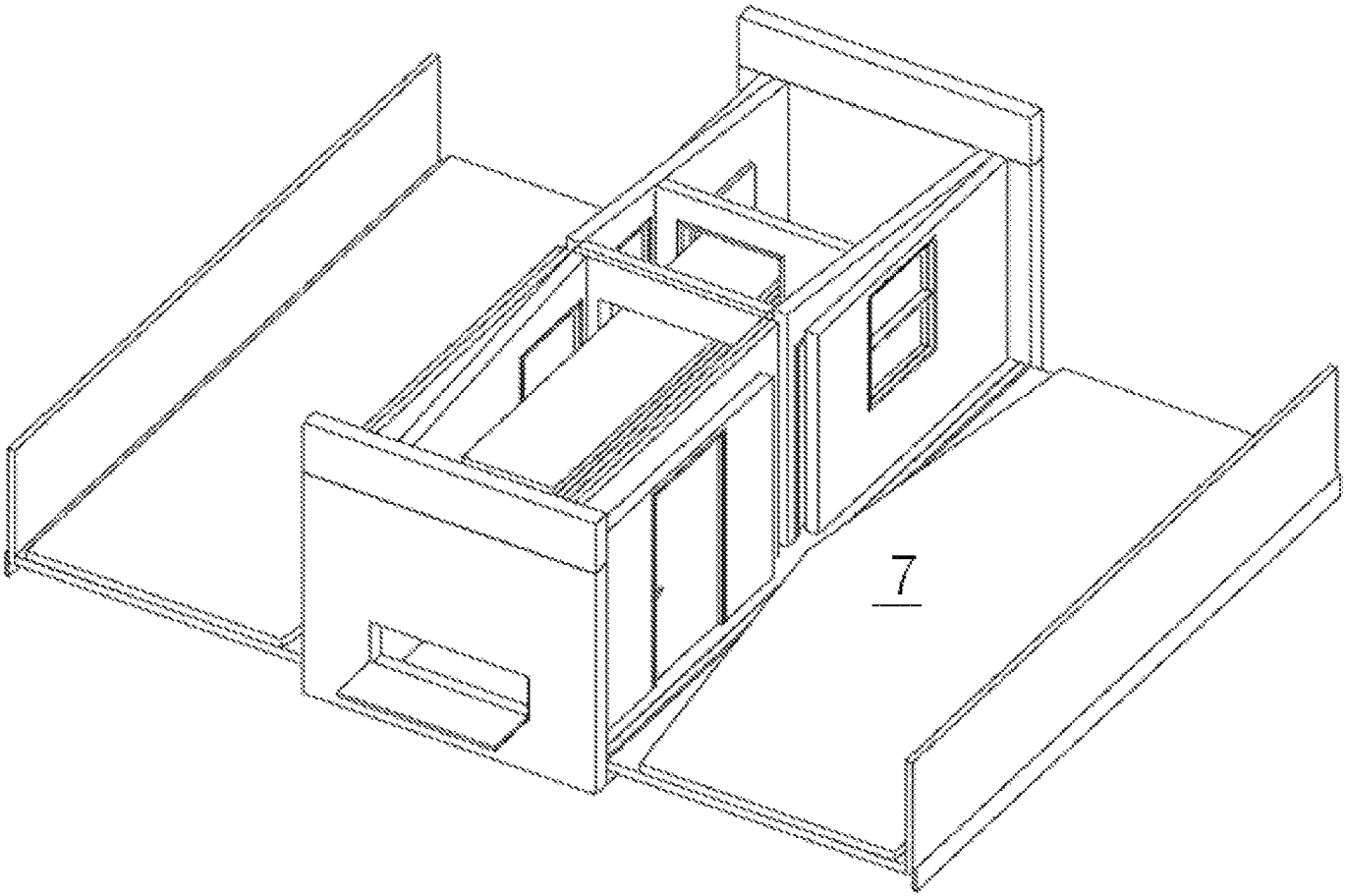
Figure 13:
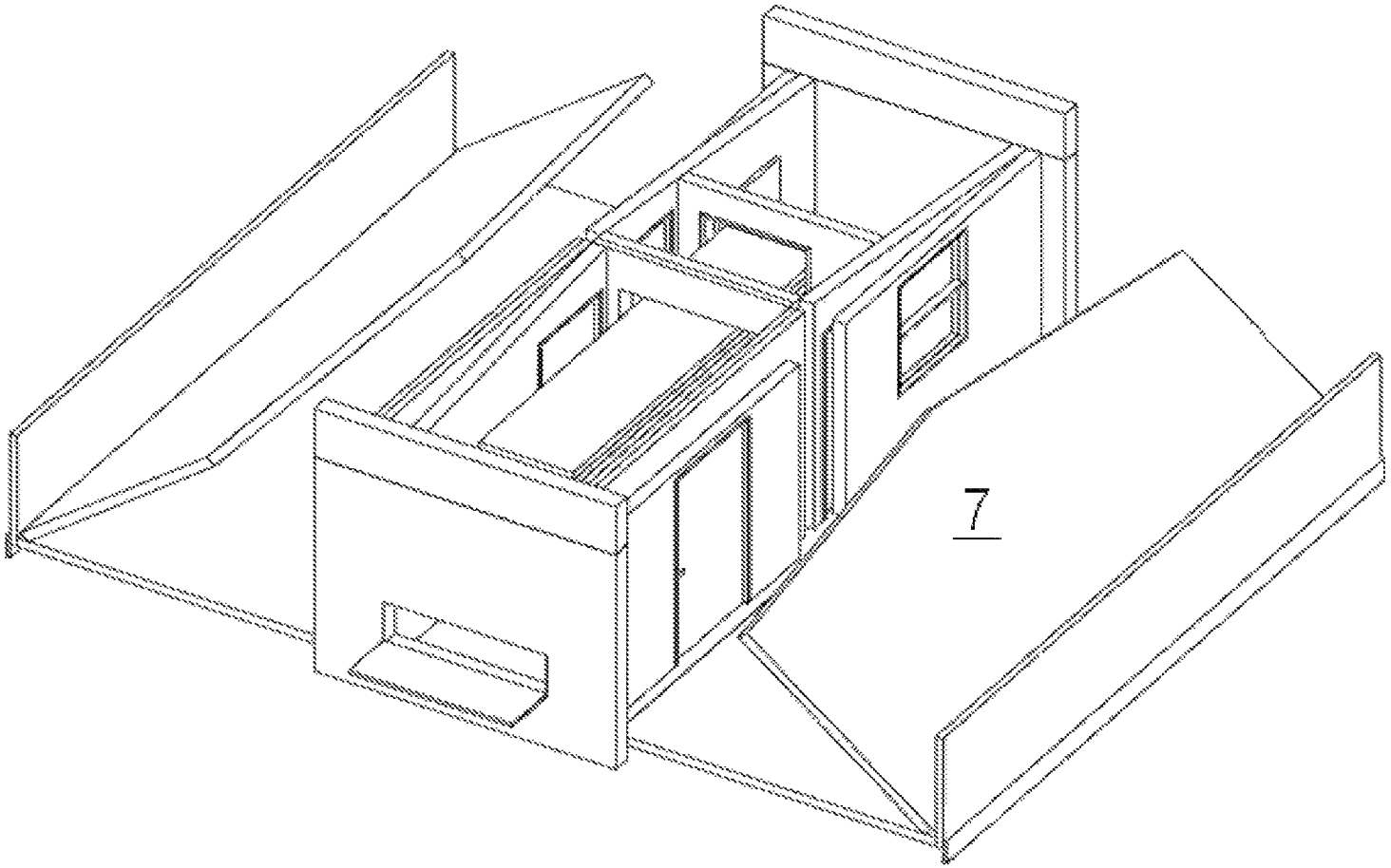
Figure 14:
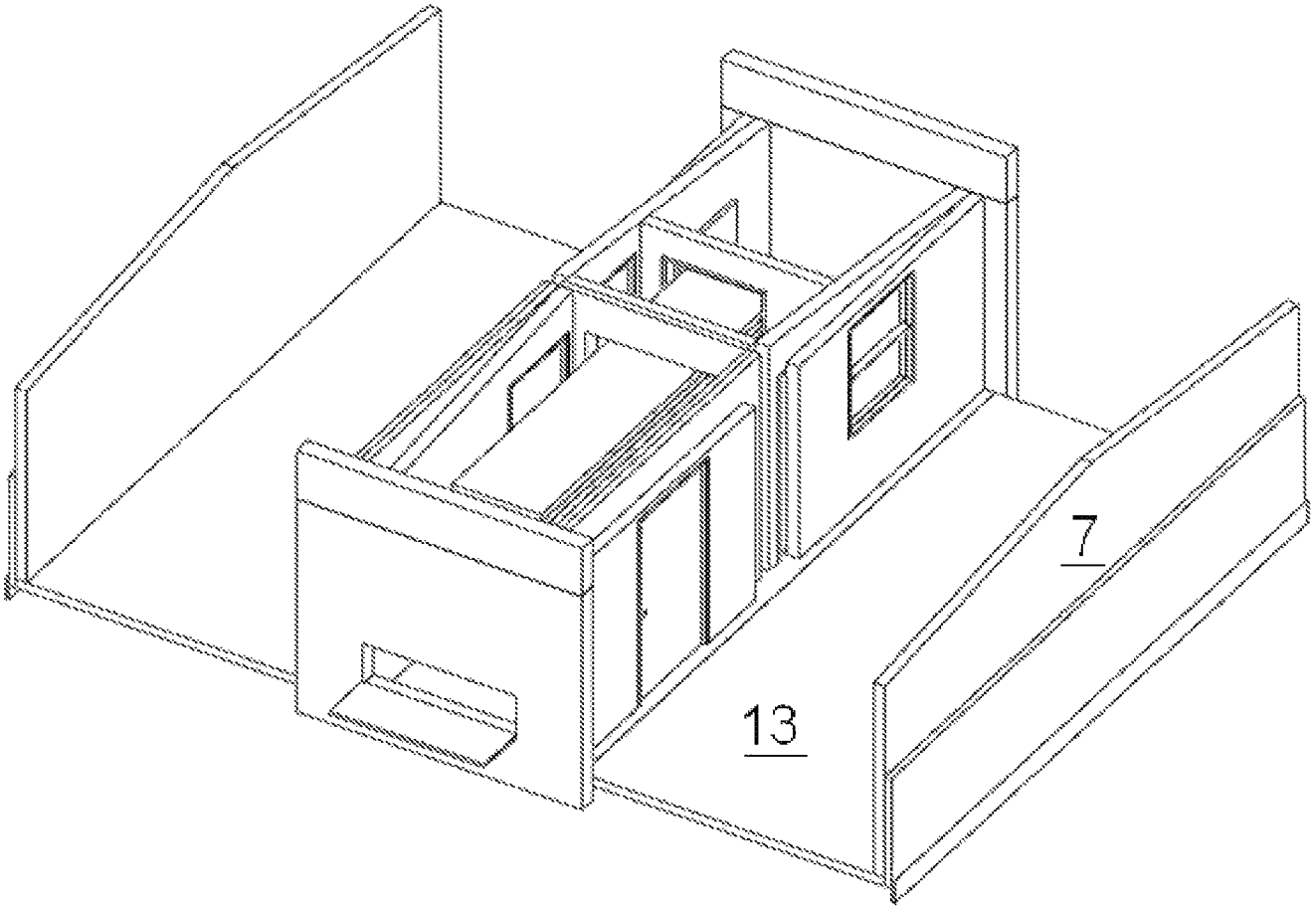
Figure 15:
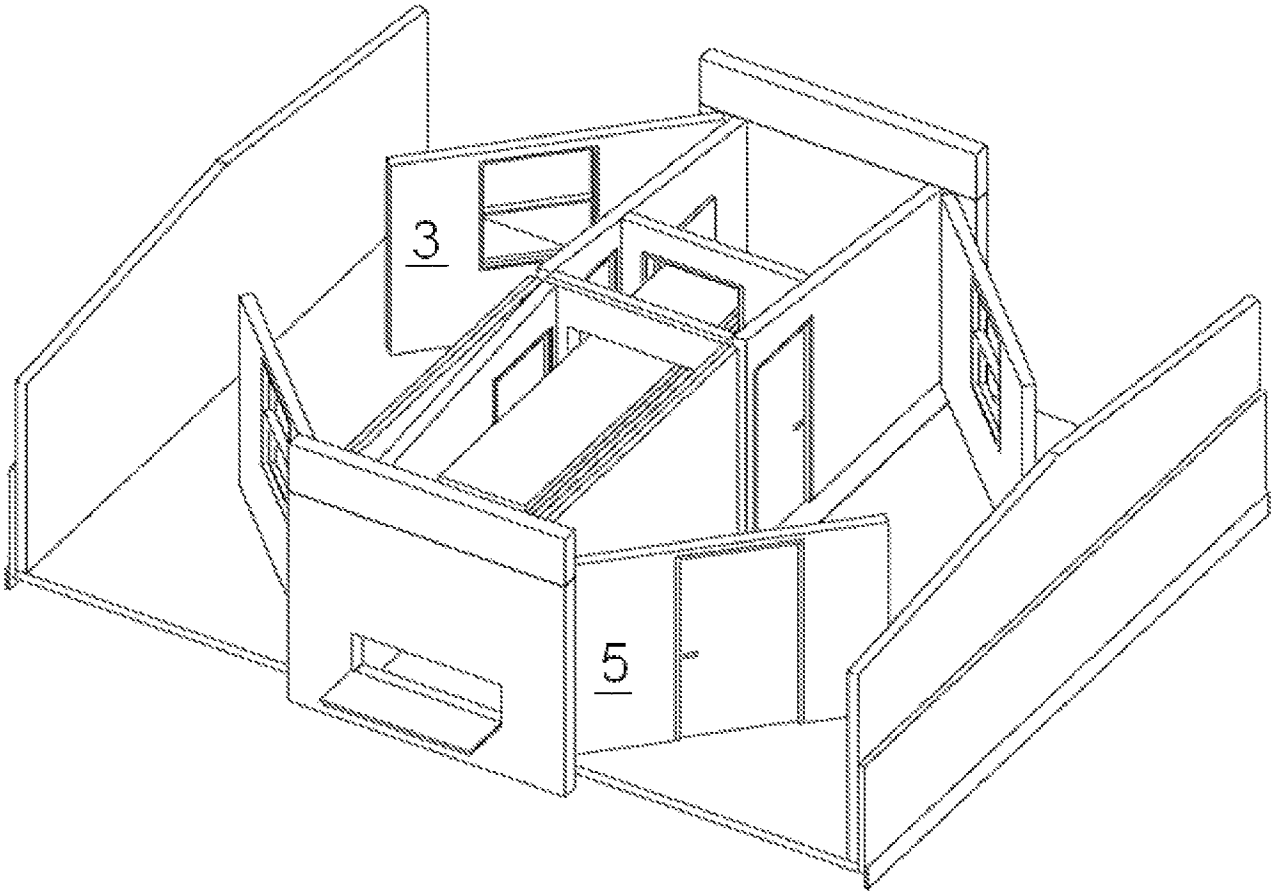
Figure 16:
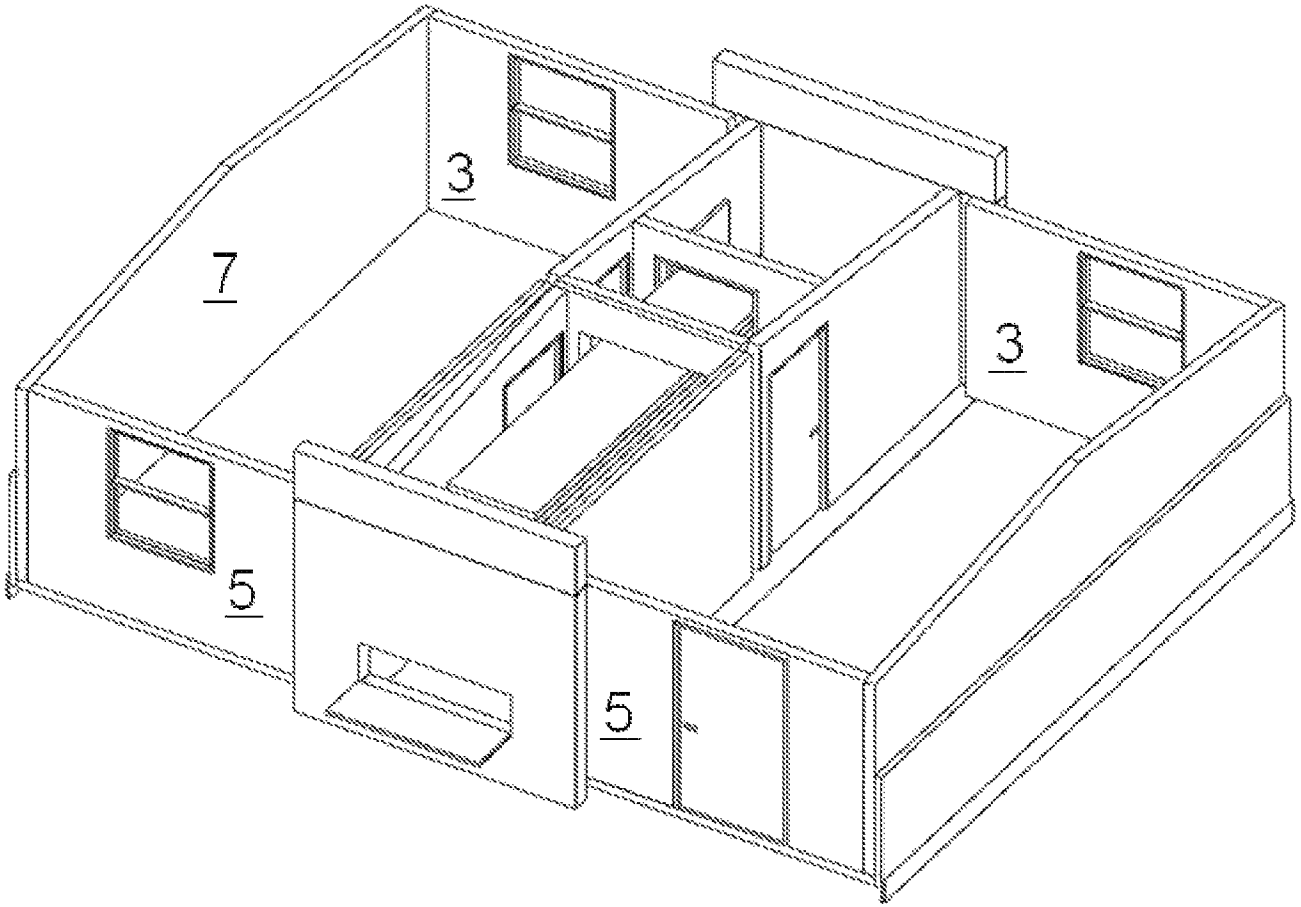
Figure 17:
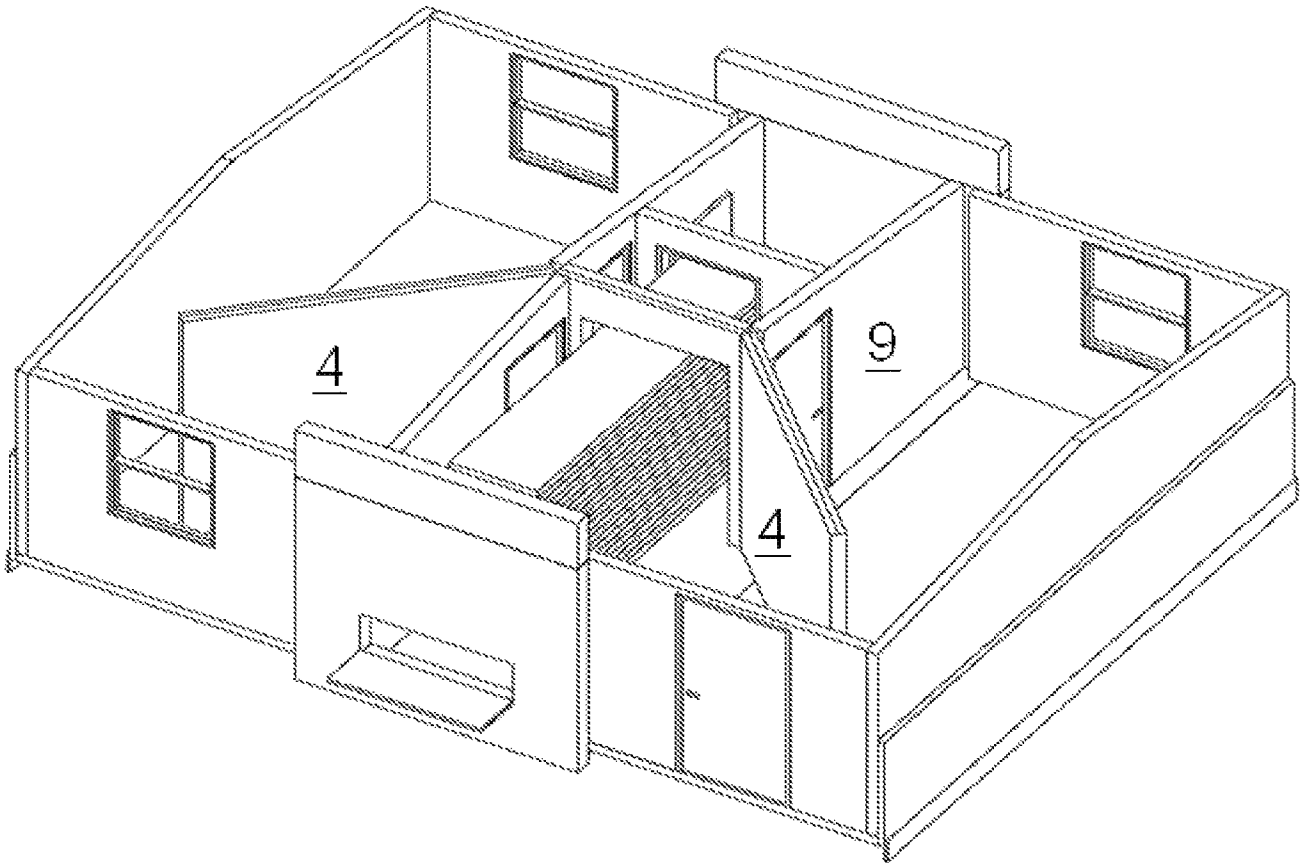
Figure 18:
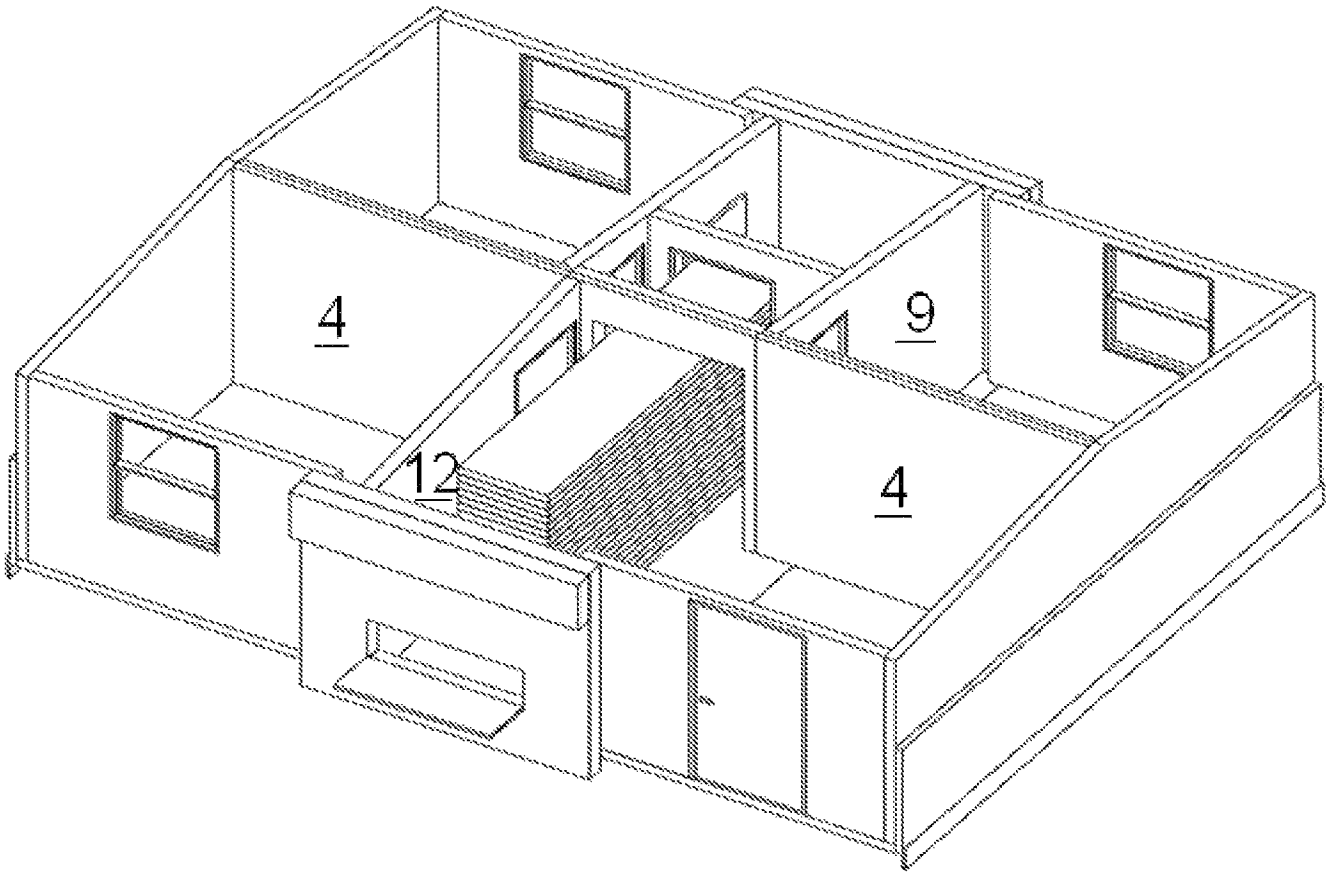
Figure 19:
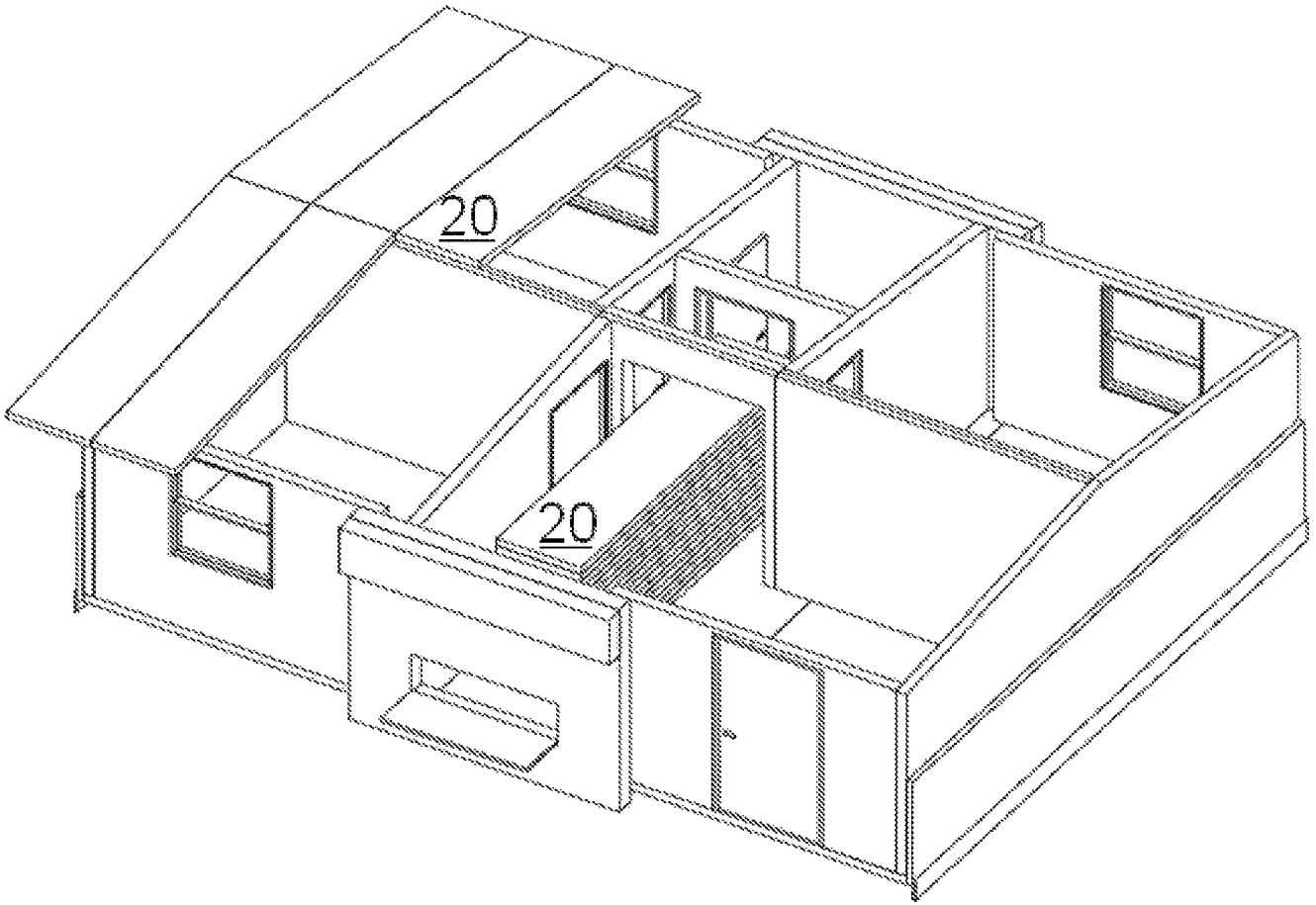
Figure 20:
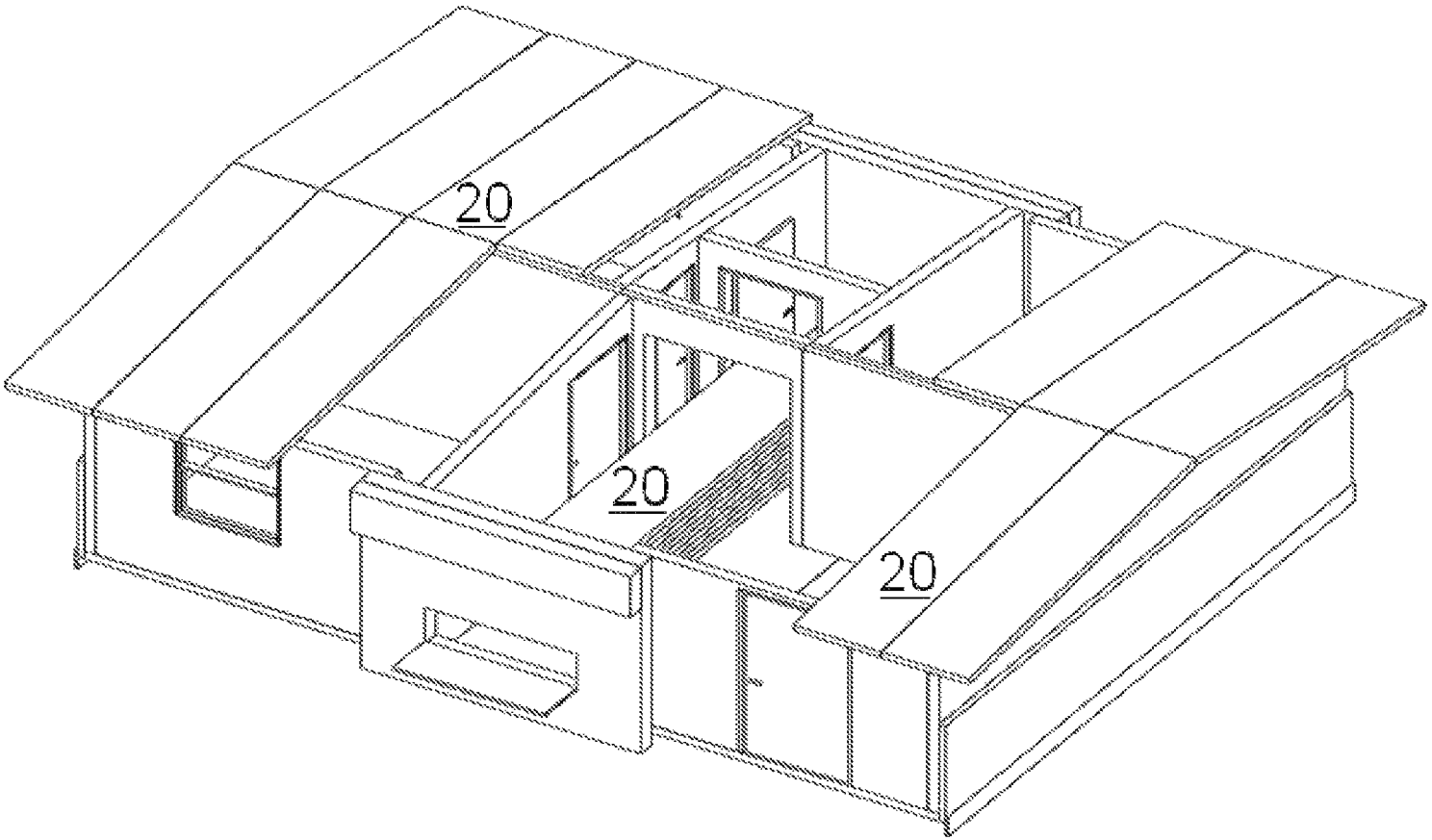
Figure 21:
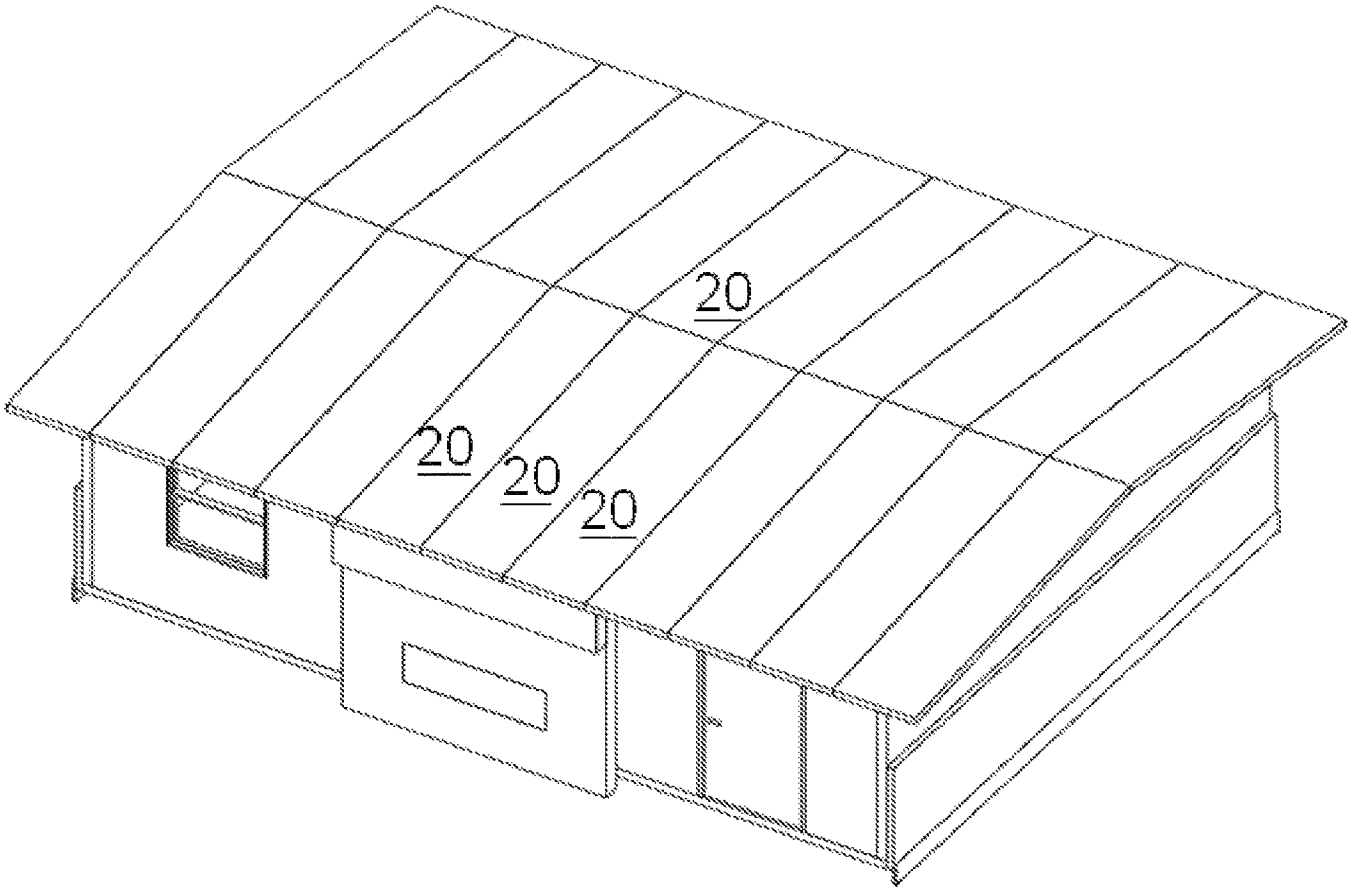
Figure 22:
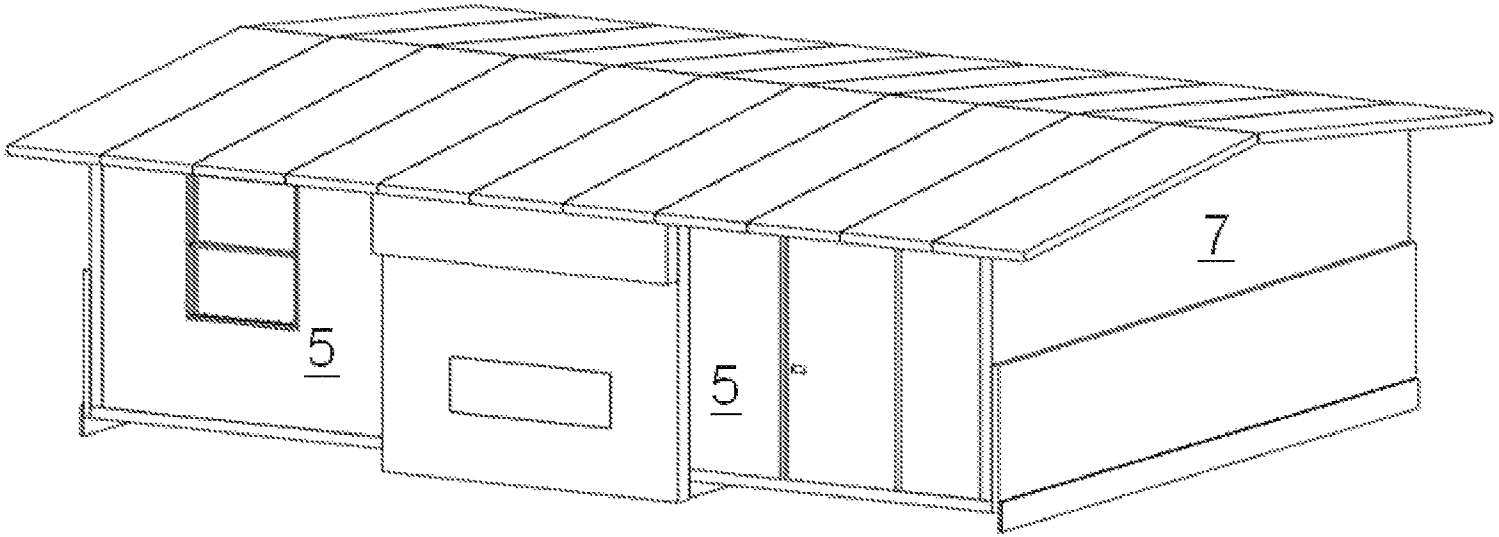
Figure 23:
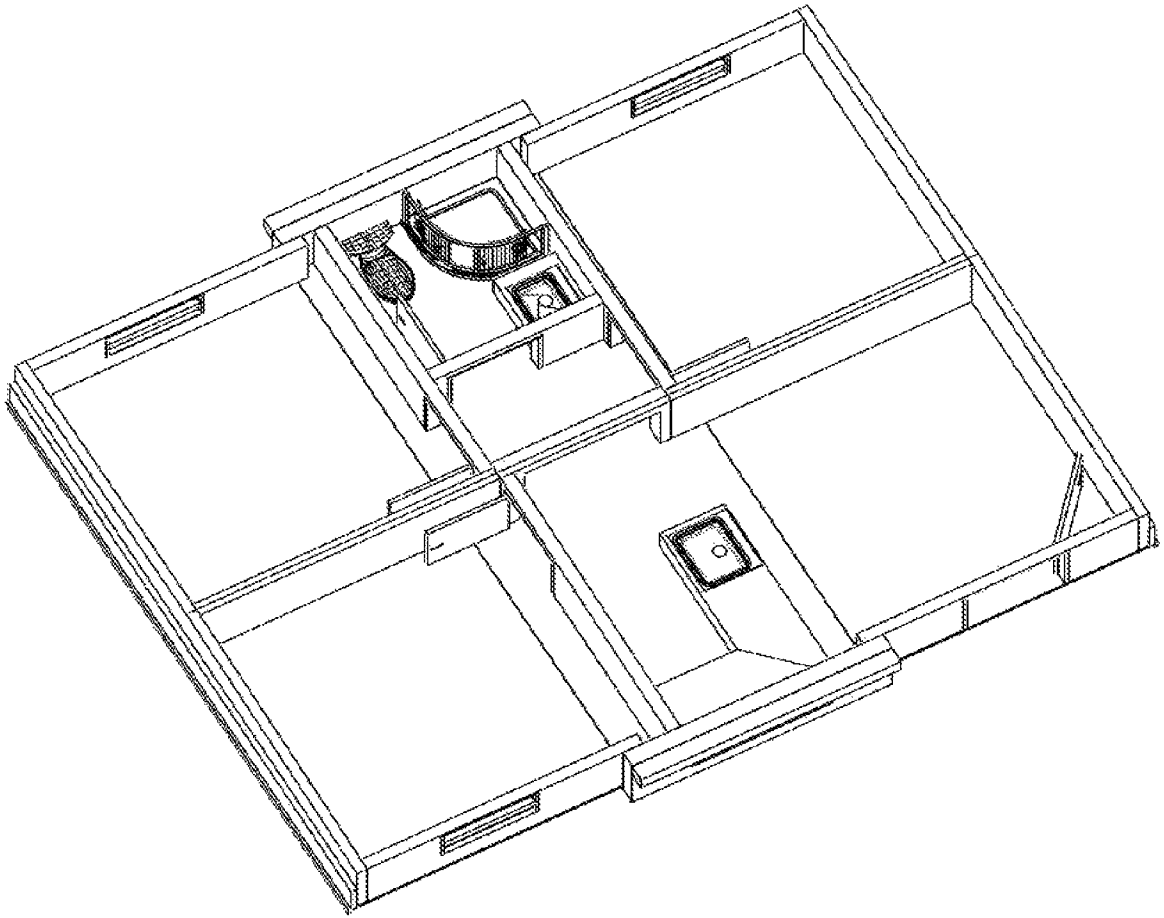

In addition to providing a means of self-leveling, the hidden telescoping container jacks 19, similar those illustrated in FIG. 10 (A-C) and depicted a contained in their jack housings 19A in FIGS. 1-3 & 8, allow the closed certified container unit to be lifted off of a platform approximately 48" from grade without crane or forklift assist. The main purposes of the container jacks 19 are to: (1) enable the lifting of the unit off a flatbed truck, in a situation where a fork lift or other heavy lifting machinery is not readily available; (2) provide for leveling the unit in installation on un-level ground; and, (3) provide sufficient vertical-load support (footing) for the unit in all areas of ground contact, which will also meet local weight-per-square-foot soil-density standards.

With the unit positioned onsite, the "pivot hinges" 15, as seen in FIGS. 4 and 5A-C, by means of the specially designed and engineered "pivot hinging" system, allow the "pivot-hinged" floors 13 to rotate from the vertical position as seen in FIGS. 2, 3, 4, 5A and 7 ninety (90) degrees to a horizontal position as seen in FIGS. 1, 5C, 6 and 8. The rotating floor hinging system comprises of an L-shaped steel bracket 21 with an attached steel rod 22 which is utilized as attachment of "pivot-hinged" floor 13 which is attached to the invention's lower steel frame 1. Each "pivot-hinged" floor 13 features a steel angle 23 which runs the entire longitudinal length and is attached to the "pivot-hinged" floor's 13 aluminum frame 24. Attached to the referenced steel angle 23 is a steel bracket 25 designed to accept a bushing 26 sized to accept the mentioned steel rod 22 attached to the main framework 1. The steel angle 23 is shown offset from the "pivot-hinged" floor 13 aluminum tube frame 24 at an exact location so that the "pivot-hinged" floor 13 will in the vertical position create a seal with the finish floor 28 on the main frame 1 and in the horizontal position, also create a flush coplanar seal between both finish floors 28 on the main frame 1 and the "pivot-hinged" floor 13.

Figure 1:
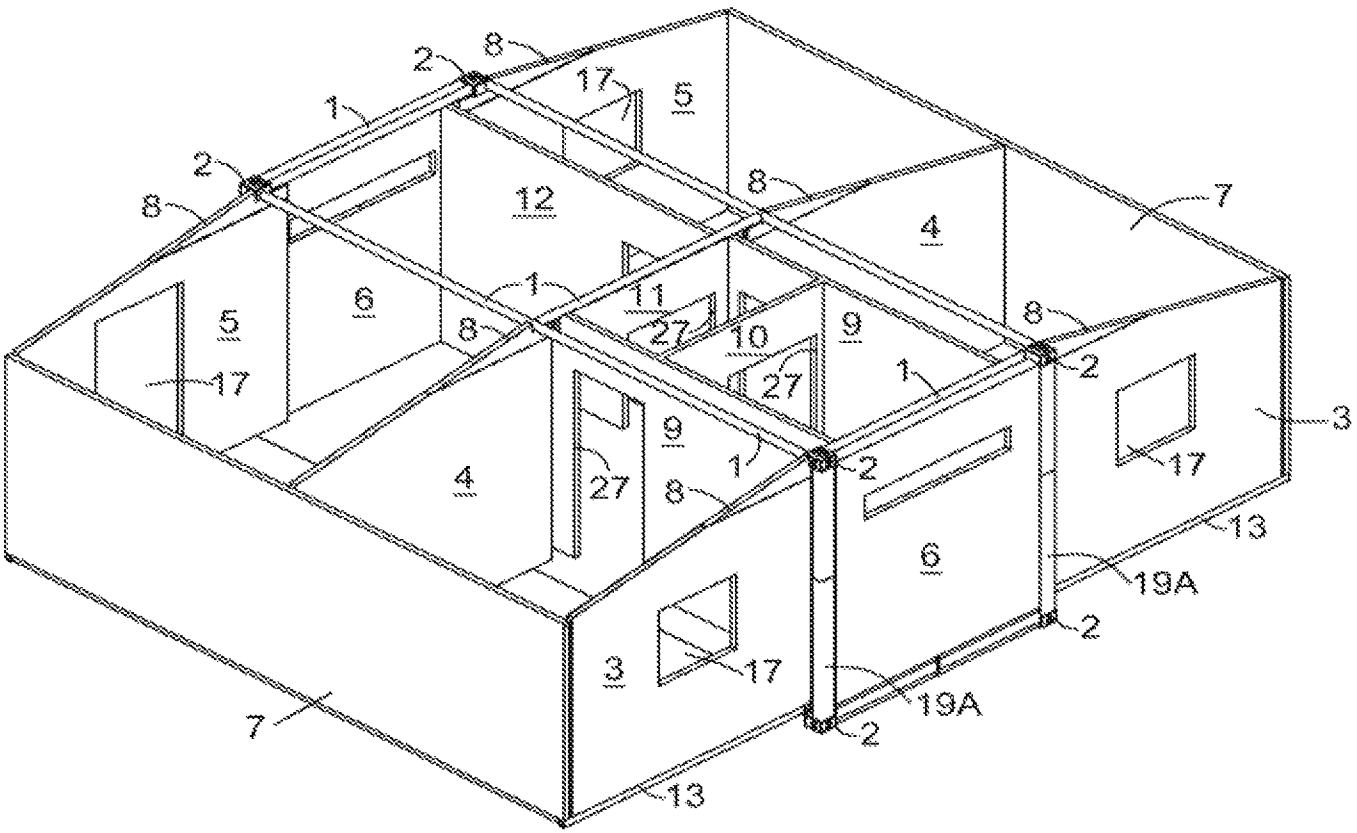
FIG. 1 is an isometric view of the invention in which the roof panels are not shown to show other details.

With rotated "pivot-hinged" floors 13 in the horizontal position, wall 7 is lifted naturally into a vertical position via three (3) specially designed and engineered "box hinges" (not shown), and is designed to naturally create a seal between itself and the "pivot-hinged" floors 13 as seen in FIGS. 1 and 8.

Figure 6:
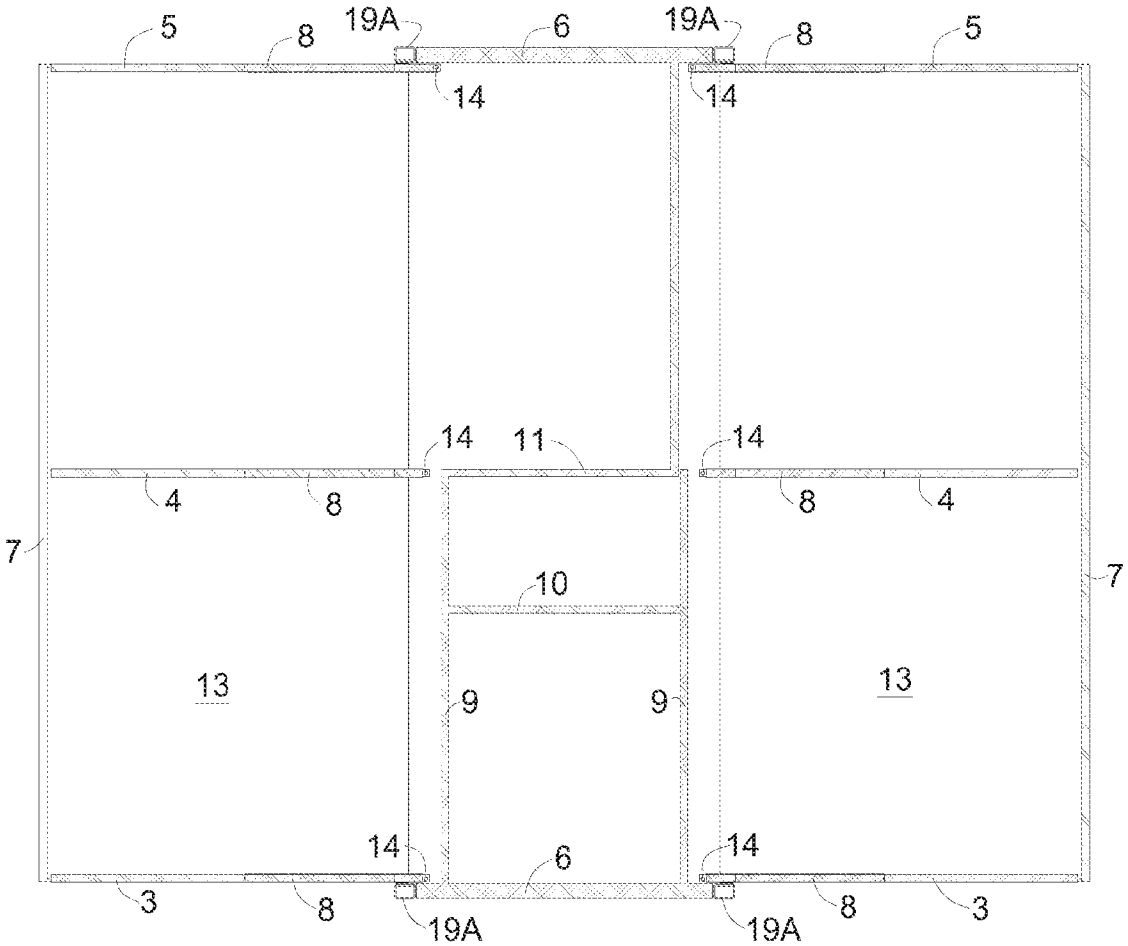
FIG. 6 is a top view of the invention in the open, habitable position in which the roof panels are not shown in order to exhibit other details.

Six swing walls 3, 4, 5 swing-pivot out from their transportable position (FIGS. 2, 3 and 4) ninety (90) degrees, on specially designed and engineered "pivot pins" 14, along the vertical axis to their open habitable position as seen in FIGS. 1, 6 and 8 and are locked in place via previously installed, specially designed and engineered "spring bolts" R-5 between the exterior lift wall 7 and the swing walls 3, 4, 5. The hinged swing wall top corner fillers 8 are flipped up 180 degrees along the horizontal axis on each of the six swing walls 3, 4, 5 to fill the void created when insulated roofing panels 20 are installed thus creating a thermal seal between the climate-controlled interior habitable space and the outside elements. Each of the four exterior swing walls 3,5 is fitted with either an exterior insulated ADA-compliant door or window 17 as is each of the permanent end walls 6. Permanent interior walls 9, 10 and 12 are equipped with ADA-compliant doorways 27. Permanent interior walls 10 and 11 create an ADA-compliant walkway.

With all mechanically transforming features in the open position, as seen in FIGS. 1, 6 and 8, the insulated roofing panels 20 must be attached via specially designed and engineered "spring bolts" R-5 to the swing walls 3, 4, 5 and exterior lift walls 7 thus finishing the transformation to an insulated, habitable housing unit as seen in FIG. 8, meeting HUD's standards for habitable structures.

What is claimed is:

1. A container/shelter assembly expandable from a closed container transport state to an expanded habitable state, the assembly comprising:

a container frame including:

a horizontal floor section and an opposed horizontal roof section; and first and second opposed vertical end sections;

first and second floor panels, one each pivotally connected to a respective opposite longitudinal side of the container floor section, each of the first and second floor panels including a distal longitudinal edge spaced-apart from the container floor section, each of the first and second floor panels pivotable between a closed vertical position and an open horizontal position;

a first exterior side wall panel pivotally connected to the distal longitudinal edge of the first floor panel;

a second exterior side wall panel pivotally connected to the distal longitudinal edge of the second floor panel;

first, second, third and fourth vertical exterior end wall panels, each of the first and second exterior end wall panels pivotally connected to the container frame adjacent the first container end section, each of the third and fourth exterior end wall panels pivotally connected to the container frame adjacent the second container end section;

a first vertical interior wall panel pivotally connected to the container frame between the first and third exterior end wall panels;

a second vertical interior wall panel pivotally connected to the container frame between the second and fourth exterior end wall panels; and a plurality of roof panels;

wherein, in the closed container state:

each of the first and second floor panels are oriented vertically such that the first and second container end sections, the first and second floor panels, the container floor section and the container roof section define an closed container having an interior;

the first and second exterior side wall panels, the first, second, third and fourth vertical exterior end wall panels, and the first and second vertical interior wall panels are disposed within the interior of the closed container; and the roof panels are removably held in the container interior;

and wherein, in the expanded habitable state:

the first and second floor panels are pivoted in opposite directions such that each of the first and second floor panels is oriented horizontally and extends away from the container floor section;

the first and second exterior side wall panels are pivoted such that each is oriented vertically;

the first and second exterior end wall panels are pivoted in opposite directions such that each extends away from and is substantially parallel to the first container end section;

the third and fourth exterior end wall panels are pivoted in opposite directions such that each extends away from and is substantially parallel to the second container end section;

the first and second interior wall panels are pivoted in opposite directions such that the first interior wall is aligned with and substantially parallel to the first and third exterior end wall panels and the second interior wall is aligned with and substantially parallel to the second and fourth exterior end wall panels;

wherein each of the first, second, third and fourth vertical exterior end wall panels and the first and second vertical interior wall panels has a top edge that has a sloped portion and a flat portion and a wedge-shaped filler member pivotally connected to the top edge at the flat portion, wherein, in the expanded habitable state, each filler member is pivoted upwardly on the flat portion to form a roof panel mounting surface that has a constant slope; and wherein, in the expanded habitable state, the roof panels are attached to upper portions of the exterior side wall panels, the exterior end wall panels, the pivotable interior wall panels and the filler members.

2. The assembly of claim 1, wherein the container frame comprises four vertically-extending container corner members, each corner member including an ISO-certified corner fitting at a top and bottom portion thereof, and wherein:

the horizontal container floor section extends between the bottom portions of the corner members and the horizontal container roof section extends between the top portions of the corner members; and the first vertical container end section extends between one pair of the corner members and the second, opposed vertical container end section extends between the other pair of the corner members.

3. The assembly of claim 1, wherein the first exterior side wall panel is pivotally connected to the first floor panel via at least one box hinge and the second exterior side wall panel pivotally connected to the second floor panel via at least one box hinge, wherein, in the expanded habitable state, each of the first and second exterior side wall panels is pivoted upwardly to form a vertical exterior wall, and wherein the box hinges are configured to retain the first and second exterior side walls in a vertical orientation.

4. The assembly of claim 2, wherein the at least some of the exterior end wall panels include at least one of an ADA-compliant window and an ADA-compliant door, wherein each of the first and second exterior end wall panels is pivotally connected to the container frame adjacent the first container end section and a respective one of the container corner members, wherein each of the third and fourth exterior end wall panels is pivotally connected to the container frame adjacent the second container end section and a respective one of the container corner members, wherein, in the closed container state, the first and second exterior end wall panels are oriented substantially perpendicular to the first container end section and the third and fourth exterior end wall panels are oriented substantially perpendicular to the second container end section.

5. The assembly of claim 4, wherein, in the expanded habitable state:

the first and third exterior end wall panels are each lockingly engaged with the first exterior side wall panel at spaced-apart locations thereof; and the second and fourth exterior end wall panels are each lockingly engaged with the second exterior side wall panel at spaced-apart locations thereof.

6. The assembly of claim 1, wherein the first pivotable interior wall panel is pivotally connected to a first longitudinal side of at least one of the container floor section and the container roof section, wherein the second pivotable interior wall panel is pivotally connected to a second, opposite longitudinal side of at least one of the container floor section and the container roof section, wherein, in the closed container state the first and second pivotable interior wall panels are substantially perpendicular to the first and second container end sections, and wherein, in the expanded habitable state:

the first pivotable interior wall panel is pivoted outwardly so as to be substantially parallel to the first and second container end sections with the first pivotable interior wall panel adjacent the first exterior side wall panel; and the second pivotable interior wall panel is pivoted outwardly so as to be substantially parallel to the first and second container end sections with the second pivotable interior wall panel adjacent the second exterior side wall panel.

7. The assembly of claim 6, wherein, in the expanded habitable state:

the first pivotable interior wall panel is lockingly engaged with the first exterior side wall panel; and the second pivotable interior wall panel is lockingly engaged with the second exterior side wall panel.

8. The assembly of claim 1, further comprising a plurality of fixed interior walls, each of the fixed interior walls fixedly attached to the container floor section, wherein at least some of the fixed interior walls are oriented substantially perpendicular to the first and second container end sections, wherein at least some of the fixed interior walls are oriented substantially parallel to the first and second container end sections, and wherein at least some of the interior walls include an ADA-compliant doorway.

9. The assembly of claim 1, wherein at least some of the floor panels, the exterior side wall panels, the exterior end wall panels, the pivotable interior wall panels, the fixed interior wall panels, the container end sections, the container floor section, the container roof section and the roof panels are insulated.

10. The assembly of claim 1, wherein:

in the closed transportable container state, the assembly is a sealed ISO-certified container having dimensions of 8 feet wide, 9 feet, six inches tall, and 20, 30 or 40 feet long; and in the expanded habitable state, with the roof panels attached, the assembly forms a HUD-certified structure.

11. The assembly of claim 1, wherein, in the open horizontal position, an upper surface of each of the first and second floor panels is substantially flush with an upper surface of the container floor section.

12. A method for rapidly deploying and erecting a HUD-certified structure, the method comprising:

providing an ISO-certified container, the container comprising:

a container frame including opposed horizontal container floor and horizontal container roof sections and opposed first and second vertical container end sections, the container further comprising first and second opposed vertical floor panels pivotally connected to the container floor sections at opposite longitudinal sides thereof, wherein the container has an interior with a plurality of dwelling members disposed therein, the plurality of dwelling members including:

a first exterior side wall panel pivotally connected to a distal longitudinal edge of the first floor panel that is spaced-apart from the container floor section and a second exterior side wall panel pivotally connected to a distal longitudinal edge of the second floor panel that is spaced-apart from the container floor section;

first and second exterior end wall panels pivotally connected to the container frame adjacent the first vertical end section and third and fourth exterior wall pivotally connected to the container frame adjacent the second vertical end section, wherein each of the first, second, third and fourth exterior end wall panels has a top edge that has a sloped portion and a flat portion and a wedge-shaped filler member pivotally connected to the top edge at the flat portion;

first and second pivotable interior wall panels pivotally connected to the container frame, wherein each of the first and second interior wall panels has a top edge that has a sloped portion and a flat portion and a wedge-shaped filler member pivotally connected to the top edge at the flat portion; and a plurality of roofing panels releasably held in the interior of the container; transporting the ISO-certified container to a desired location; and forming a HUD-certified structure at the desired location, including:

pivoting the first and second vertical floor panels downwardly and outwardly such that each floor panel is oriented horizontally and extends away from an opposite longitudinal side of container frame floor section;

pivoting the first exterior side wall panel upwardly from the distal longitudinal edge of the horizontally disposed first floor panel and pivoting the second exterior side wall panel upwardly from the distal longitudinal edge of the horizontally disposed second floor panel such that the first and second exterior side wall panels are vertically disposed; then pivoting the first and second exterior end wall panels outwardly in opposite directions such that a distal end of the first exterior end wall panel is adjacent the first exterior side wall panel and a distal end of the second exterior end wall panel is adjacent the second exterior side wall panel;

pivoting the third and fourth exterior end wall panels outwardly in opposite directions such that a distal end of the third exterior end wall panel is adjacent the first exterior side wall panel and a distal end of the fourth exterior end wall panel is adjacent the second exterior side wall panel;

pivoting the first pivotable interior wall panel outwardly such that a distal end thereof is adjacent the first exterior side wall panel and pivoting the second pivotable interior wall panel outwardly such that a distal end thereof is adjacent the second exterior side wall panel;

pivoting the filler member of each of the first, second, third and fourth exterior end wall panels and the first and second interior wall panels upwardly on the flat portion to form a roof panel mounting surface that has a constant slope; and then attaching the roof panels to top portions of the exterior side wall panels, the exterior end wall panels, the pivotable interior wall panels, the filler members and/or the container frame roof section.

13. The method of claim 12, wherein the first exterior side wall panel is pivotally connected to the first floor panel via at least one first box hinge and the second exterior side wall panel is pivotally connected to the second floor panel via at least one box hinge, wherein the box hinges are configured to retain the first and second exterior side walls in a vertical orientation.

14. The method of claim 12, further comprising:

lockingly engaging the first and third exterior end wall panels with the first exterior side wall panel at spaced-apart locations thereof; and lockingly engaging the second and fourth exterior end wall panels with the second exterior side wall panel at spaced-apart locations thereof.

15. The method of claim 12, comprising:

pivoting the first pivotable interior wall panel outwardly so as to be substantially parallel to the first and second container end sections; and pivoting the second pivotable interior wall panel outwardly so as to be substantially parallel to the first and second container end sections.

16. The method of claim 12, comprising:

lockingly engaging the first pivotable interior wall panel with the first exterior side wall panel; and lockingly engaging the second pivotable interior wall panel with the second exterior side wall panel.

17. The method of claim 12, wherein the plurality of dwelling members comprises a plurality of fixed interior walls, each of the fixed interior walls fixedly attached to the container floor section, wherein at least some of the fixed interior walls are oriented substantially perpendicular to the first and second container end sections, wherein at least some of the fixed interior walls are oriented substantially parallel to the first and second container end sections, and wherein at least some of the interior walls include an ADA-compliant doorway.

18. The method of claim 12, comprising pivoting the first and second floor panels such that an upper surface of each of the first and second floor panels is substantially flush with an upper surface of the container floor section.

19. The method of claim 12, further comprising:

obtaining ISO certification for the container prior to providing the ISO-certified container; and obtaining HUD approval of the container and the dwelling members disposed therein prior to transporting the ISO-certified container.

* * * * *